PADLOCK

BACKGROUND OF THE INVENTION

The present invention relates to a padlock having a body portion and a shackle member lockable therein.

A padlock is known in the art, having a body portion whose one axial end is provided with a circular hole for accommodating a rotatable drum, and a plurality of blind holes extend inwardly from the circular hole. A drum is rotably received in the circular hole and has a plurality of through-going holes whose location and number correspond to those of the first-mentioned holes of the body portion. A spring, an inner pin, and an outer pin are located in a respective one of the through-going holes of the body portion and the drum. The outer pins have differring lengths. When a key having a plurality of projections of differing lengths is inserted into the drum so that the projections are inserted into the through-going holes of the drum, the outer pins move the inner pins against the force of the springs so that the proximal ends of the outer pins and inner pins coincide with an axial interface between the body portion and the drum. Thereby, the drum can rotate and engage or disengage a slot provided in one end section of the shackle member so that the latter can be locked in or unlocked from the body portion. The other end section of the shackle member is spring-biased in the body portion. Such a construction is disclosed, for example, in the Inventor's Certificate of the USSR No. 275 274. This construction has a disadvantage that its safety or "secrecy" is limited to combination of the holes of only one drum and the projections of only one key. Furthermore, the spring-biasing of the other end section of the shackle member is complicated. The known lock must have and actually has a cover which covers the drum from outside and holds it in connected condition with the body portion.

SUMMARY OF THE INVENTION

Accordingly, it is an object of the present invention to provide a padlock which has a higher safety or secrecy as compared with the known padlock, and at the same time is of a simple construction and easy to manufacture.

In keeping with these objects and with others which will become apparent hereinafter, one feature of the present invention resides in that two receiving holes are provided in two axial ends of a body of the padlock, and two drums are rotably received in these holes, the drums being provided with outer pins of differing lengths, and also in that common springs are received in through-going holes of the body and act in two opposite direction upon inner pins of both drums, simultaneously. Two keys are provided having projections of differing lengths complementary to the differing lengths of the outer pins in the drums.

The above-mentioned construction has a significantly increased safety or secrecy as a result of provision of the additional set of pins in the second drum and the additional key. At the same time, this is attained in a new, original and unexpected manner. Only one set of springs are utilized for simultaneously urging the inner pins acting upon the outer pins of two drums. This provides for material economy, simplicity of construction, and easiness to manufacture.

The novel features of the present invention are set forth in particular in the appended claims. The invention itself, however, will be best understood from the following description of preferred embodiment taking together with the accompanying drawing.

BRIEF DESCRIPTION OF THE DRAWING

FIG. 1 is an axial section of a padlock in accordance with the present invention;

FIGS. 2 and 3 are side views of the padlock shown in FIG. 1;

FIGS. 4 and 5 are sections of the padlock in the regions of axial end portions in a direction transverse to the padlock axis; and FIG. 6 is a view showing a key for the inventive padlock.

DESCRIPTION OF PREFERRED EMBODIMENTS

A padlock in accordance with the present invention has a body identified by reference numeral 1 and having a central portion 2 and two end portions 3 and 4. They are connected with one another, for example, by riveting. The central portion 2 may be composed of a plurality of sheets. The end portions 3 and 4 have receiving axial holes 3' and 4' and two transverse holes 3'' and 4'', respectively.

A shackle member 5 has two end sections receivable in the transverse holes 3'' and 4'' of the end portions 3 and 4 of the body 1 and each having an arcuate slot 5'. Two drums 6 and 7 are further provided. Each drum is received in the receiving hole of the respective end portion of the body 1, so as to form an axial interface between an inner axial surface of the drum and an axially outer surface of the central portion 2 of the body 1.

Each drum has a plurality of through-going holes 6' and 7' respectively, of an identical number and location. As can be seen from the drawing, the through-going holes 6' and 7' are stepped. The above mentioned holes are provided in the drums. The central portion 2 of the body 1 also has through-going holes 2' whose number and location correspond to those of the through-going holes 6' and 7' of the end portions 6 and 7.

A plurality of outer pins 8 are located in the trough-going holes 6' of the drum 6, and a plurality of outer pins 9 are located in the through-going holes 7' of the drum 7. Inner pins 10 and 11 are provided. In the position shown in FIG. 1, the inner pins extend both through the holes 6' and 7' of the drums 6 and 7 and the holes 2' of the central portion of the body 1. Springs 12 are located between the inner pins 10 and 11 and are operative for urging the latter axially outwardly in two opposite axial directions.

The drums 6 and 7 have arcuate engaging portions 13 and 14, respectively. Stops 15 and 16 are located in a path of the arcuate engaging portions 13 and 14, respectively. The arcuate engaging portions 13 and 14 can engage in the slots 5' of the end sections of the shackle member 5.

At least two outer pins 6' have differing lengths, and at least two outer pins 7' have also differing lengths. At least one pin 6' has a length differing from the length of one of the pins 7'. In practice, all pins 6' and 7' have differing lengths.

Two keys 17 and 18 having projections 17' and 18' are provided. The projections 17' have lengths which are complementary to the length of the outer pins 8, whereas the projections 18' have lengths which are complementary to the lengths of the outer pins 10. As FIG. 1
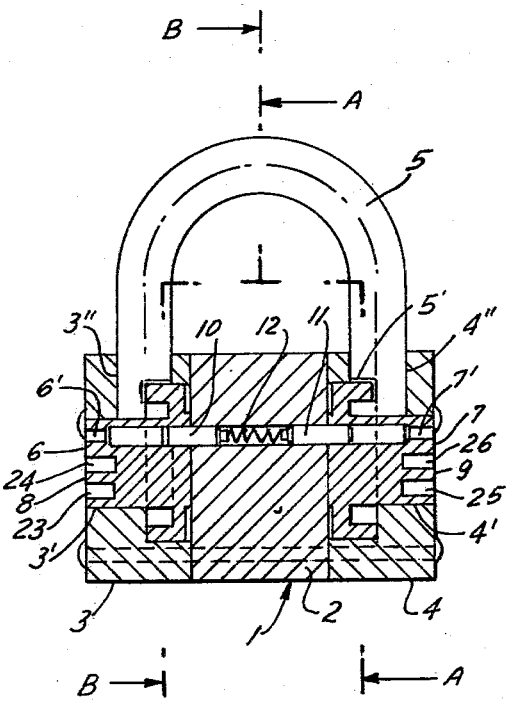
FIG. 2
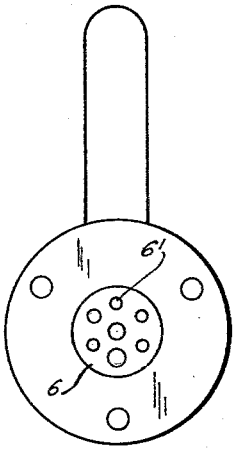
FIG. 3
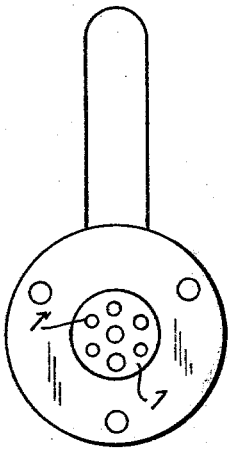
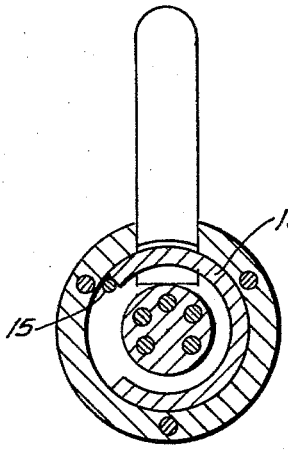
FIG. 4
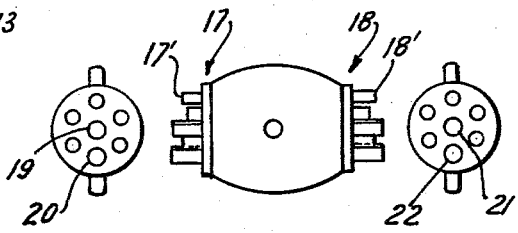
FIG. 6
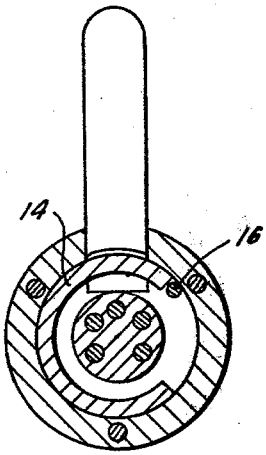
FIG. 5

PADLOCK

BACKGROUND OF THE INVENTION

The present invention relates to a padlock having a body portion and a shackle member lockable therein.

A padlock is known in the art, having a body portion whose one axial end is provided with a circular hole for accommodating a rotatable drum, and a plurality of blind holes extend inwardly from the circular hole. A drum is rotably received in the circular hole and has a plurality of through-going holes whose location and number correspond to those of the first-mentioned holes of the body portion. A spring, an inner pin, and an outer pin are located in a respective one of the through-going holes of the body portion and the drum. The outer pins have differring lengths. When a key having a plurality of projections of differing lengths is inserted into the drum so that the projections are inserted into the through-going holes of the drum, the outer pins move the inner pins against the force of the springs so that the proximal ends of the outer pins and inner pins coincide with an axial interface between the body portion and the drum. Thereby, the drum can rotate and engage or disengage a slot provided in one end section of the shackle member so that the latter can be locked in or unlocked from the body portion. The other end section of the shackle member is spring-biased in the body portion. Such a construction is disclosed, for example, in the Inventor's Certificate of the USSR No. 275 274. This construction has a disadvantage that its safety or "secrecy" is limited to combination of the holes of only one drum and the projections of only one key. Furthermore, the spring-biasing of the other end section of the shackle member is complicated. The known lock must have and actually has a cover which covers the drum from outside and holds it in connected condition with the body portion.

SUMMARY OF THE INVENTION

Accordingly, it is an object of the present invention to provide a padlock which has a higher safety or secrecy as compared with the known padlock, and at the same time is of a simple construction and easy to manufacture.

In keeping with these objects and with others which will become apparent hereinafter, one feature of the present invention resides in that two receiving holes are provided in two axial ends of a body of the padlock, and two drums are rotably received in these holes, the drums being provided with outer pins of differing lengths, and also in that common springs are received in through-going holes of the body and act in two opposite direction upon inner pins of both drums, simultaneously. Two keys are provided having projections of differing lengths complementary to the differing lengths of the outer pins in the drums.

The above-mentioned construction has a significantly increased safety or secrecy as a result of provision of the additional set of pins in the second drum and the additional key. At the same time, this is attained in a new, original and unexpected manner. Only one set of springs are utilized for simultaneously urging the inner pins acting upon the outer pins of two drums. This provides for material economy, simplicity of construction, and easiness to manufacture.

The novel features of the present invention are set forth in particular in the appended claims. The invention itself, however, will be best understood from the following description of preferred embodiment taking together with the accompanying drawing.

BRIEF DESCRIPTION OF THE DRAWING

FIG. 1 is an axial section of a padlock in accordance with the present invention;

FIGS. 2 and 3 are side views of the padlock shown in FIG. 1;

FIGS. 4 and 5 are sections of the padlock in the regions of axial end portions in a direction transverse to the padlock axis; and FIG. 6 is a view showing a key for the inventive padlock.

DESCRIPTION OF PREFERRED EMBODIMENTS

A padlock in accordance with the present invention has a body identified by reference numeral 1 and having a central portion 2 and two end portions 3 and 4. They are connected with one another, for example, by riveting. The central portion 2 may be composed of a plurality of sheets. The end portions 3 and 4 have receiving axial holes 3' and 4' and two transverse holes 3'' and 4'', respectively.

A shackle member 5 has two end sections receivable in the transverse holes 3'' and 4'' of the end portions 3 and 4 of the body 1 and each having an arcuate slot 5'. Two drums 6 and 7 are further provided. Each drum is received in the receiving hole of the respective end portion of the body 1, so as to form an axial interface between an inner axial surface of the drum and an axially outer surface of the central portion 2 of the body 1.

Each drum has a plurality of through-going holes 6' and 7' respectively, of an identical number and location. As can be seen from the drawing, the through-going holes 6' and 7' are stepped. The above mentioned holes are provided in the drums. The central portion 2 of the body 1 also has through-going holes 2' whose number and location correspond to those of the through-going holes 6' and 7' of the end portions 6 and 7.

A plurality of outer pins 8 are located in the trough-going holes 6' of the drum 6, and a plurality of outer pins 9 are located in the through-going holes 7' of the drum 7. Inner pins 10 and 11 are provided. In the position shown in FIG. 1, the inner pins extend both through the holes 6' and 7' of the drums 6 and 7 and the holes 2' of the central portion of the body 1. Springs 12 are located between the inner pins 10 and 11 and are operative for urging the latter axially outwardly in two opposite axial directions.

The drums 6 and 7 have arcuate engaging portions 13 and 14, respectively. Stops 15 and 16 are located in a path of the arcuate engaging portions 13 and 14, respectively. The arcuate engaging portions 13 and 14 can engage in the slots 5' of the end sections of the shackle member 5.

At least two outer pins 6' have differing lengths, and at least two outer pins 7' have also differing lengths. At least one pin 6' has a length differing from the length of one of the pins 7'. In practice, all pins 6' and 7' have differing lengths.

Two keys 17 and 18 having projections 17' and 18' are provided. The projections 17' have lengths which are complementary to the length of the outer pins 8, whereas the projections 18' have lengths which are complementary to the lengths of the outer pins 10. As can be seen from the drawing, the two keys 17 and 18 may be of onepiece with each other so as to form an integral member. However, they may be separate members. In the first mentioned case, the projections may be casted together with the body of the key, or may be produced by machining with subsequent pressing them into the body of the key.

It is also possible that the drums have holes which are not through-going, in addition to the through-going holes, and respective springs, inner pins, and outer pins are accomodated in such blind holes. The keys must have, in this case, respective projections. Since the above mentioned additional blind holes are known per se in the art and do not constitute a part of the present invention, they are not shown in the drawing.

The inventive padlock operates in the following manner: In the locked position shown in FIG. 1, the springs 12 urge the inner pins axially outwardly so that their distal ends project axially outwardly beyond the central portion 2 of the body 1 and into the drums. In this position the drums cannot rotate and the arcuate sections 13 and 14 engage in the slots 5' of the shackle member 5 so as to lock the latter in the body 1.

When the projections 17' of the key 17 are inserted into the holes 6' of the drum 6, the outer pins 8 and the inner pins 9 are moved inwardly against the force of the springs 12 so that the proximal ends of the outer pins 8 and the inner pins 9 coincide with the interface between the drum 6 and the central portion 2 of the body 1. The drum 6 can now rotate so that to withdraw the engaging section 13 from the slot 5' of one end section of the shackle member 5. Then the projections 18' of the key 18 are inserted into the holes 7' of the drum 7, The outer pins 10 and the inner pins 11 are moved inwardly against the force of the same springs 12 so that the proximal ends thereof coincide with the interface between the drum 7 and the central portion 2 of the body 1. Then the engaging section 14 are withdrawn from the slot 5' of the other end section of the shackle member 5. The shackle member 5 can now be withdrawn from the body 1, or more particularly, from the holes 3'' and 4'' of the body 1.

In the locked position, one circumferential end of the engaging members 13 and 14 abuts against the stop members 15 and 16, whereas in the unlocked position the other circumferential end of the engaging members 13 and 14 abut against the stop members 15 and 16. The drums may rotate from the locked position to the unlocked position in two opposite circumferential direction, or more particularly in the clockwise and counterclockwise directions, respectively. This means that in different positions, different circumferential ends of the two engaging members 13 and 14 engage the stops 15 and 16.

In such a padlock not only the projections of one key and the outer pins of one drum have differing lengths, but also the projections of the second key and the outer pins of the second drum have differing lengths. This improves the safety and increases the secrecy of the padlock. The opposite directions of rotation also increases the safety of the padlock. At the same time, only one set of springs is required for actuating two sets of the inner pins and outer pins.

Each key has at least two control pins 19, 20 and 21,22, respectively. The pins 19 and 20 are spaced from one another in the axial direction or/and in the circumferential direction differently as compared with the pins 21 and 22. The drums 6 and 7 have control holes 23,24 and 25,26 having location and depth corresponding to the location and heights of the control pins 19,20 and 21,22, respectively. Thus, it is easy to recognize which key must be inserted in a respective one of the drums.

The lock is material and part economical not only as a result of the provision of only one set of springs, but also since two end sections of the shackle member are inserted and withdrawn, whereby no spring-biasing of the shackle member is needed.

It is to be understood that various modifications may be made without departing in any way from the spirit of the present invention.

Without further analysis, the foregoing will so fully reveal the gist of the present invention, that others can, by applying current knowledge, readily adapt it for various applications without omitting features that, from the standpoint of the prior art, fairly constitute essential characteristics of the generic or specific aspects of the present invention which is described and claimed here in the present application.

What is claimed as new and desired to be protected by Letters Patent is set forth in the appended claims:

1. A padlock, comprising a body having an axis, two axial end portions and a central portion therebetween, each of said end portions having a first circular hole extending in an axial direction and a second hole extending in a direction which is transverse to said axial direction, said central portion having a plurality of through-going third holes which extend between and are open into said first holes;

a shackle member having two end sections and movable between a first transverse position in which said end sections are inserted into said second holes of said body, and a second transverse position in which said end sections are withdrawn from said second holes of said body, each of said end sections of said shackle member having a slot;

two drums each having an engaging section and a plurality of further through-going holes whose number and location correspond to those of said through-going holes of said central portion of said body, each of said drums being inserted in a respective one of said first holes and rotatable about said axis between a first circumferential position in which said through-going holes of said drums are in alignment with said through-going holes of said central portion of said body and said engaging section of said drums engage said slots of said end sections of said shackle member when the latter is in its first transverse position so as to lock said shackle member in said body, and a second circumferential position in which said through-going holes of said drums are withdrawn from alignment with said through-going holes of said central portion of said body and said engaging sections of said drums are withdrawn from engagement with said slots of said end sections of said shackle member so that the latter can be moved from said first transverse position to said second transverse position to thereby unlock said shackle member from said body;

a plurality of springs each located in a respective one of said through-going holes of said central portion of said body and acting in two opposite axial directions;

a plurality of pairs of inner pins having an identical length, the pins of each pair of said inner pins being located at opposite axial sides of a respective one of said springs, said inner pins being movable between a first axial position in which they extend through both said through-going holes of said central portion of said body and the through-going holes of a respective one of said drums so that distal ends of said inner pins are axially outwardly offset relative to an interfaces between said central portion of said body and a respective one of said drums whereby said drums cannot rotate about said axis, and a second circumferential position in which said pins are withdrawn from said through-going holes of said drums into said through-going holes of said central portion of said body so that said distal ends of said inner pins coincide with the interfaces between said central portion of said body and a respective one of said drums whereby the latter can rotate between said first and second circumferential positions;

a first plurality of outer pins and a second plurality of outer pins, the outer pins of said first plurality being located in said through-going holes of one of said drums whereas the outer pins of said second plurality are located in said through-going holes of the other drum, at least two outer pins of each plurality having differing lengths, and at least one outer pin of said first plurality having a length differing from the length of at least one outer pin of said second plurality; and two keys a first of which has a first plurality of projections having lengths complementary to the lengths of said outer pins of said first plurality, whereas the second key has a second plurality of projections having lengths complementary to the lengths of the outer pins of said second plurality, so that when one of said keys is inserted into said through-going holes of one of said drums, the outer pins located in said one drum urge respective inner pins against the force of said springs to said second axial position, and when the other key is inserted into said through-going holes of the other drum, the outer pins located in said other drum urge the respective inner pins against the force of the same springs to said second axial position, whereas when said one key is withdrawn and said other key is withdrawn from said drums, the same springs urge the inner pins of said pairs to said first axial position.

2. A padlock as defined in claim 1, wherein said two keys are of one piece with each other.

3. A padlock as defined in claim 1, wherein said end portions and said central portion of said body are separate members and are connected with one another, so that said springs, said inner pins and said outer pins may be inserted into respective through-going holes before connection of said portions with each other.

4. A padlock as defined in claim 1, wherein one of said drums is movable from said first circumferential position into said second circumferential position in a clockwise direction, whereas the other drum is movable from said first circumferential position into said second circumferential position in a counterclockwise direction.

5. A padlock as defined in claim 1, wherein each of said drums has an arcuate portion arranged to engage into and disengage from the slot of a respective one of said end sections of said shackle member and having two circumferentially spaced ends; and further comprising a stop member in each of said first holes and arranged so that in said first circumferential position of each drum one circumferential end of its arcuate portion abuts against a respective stop member whereas in said second circumferential position the other circumferential end of its arcuate portion abuts against said stop member.

6. A padlock as defined in claim 1, wherein each of said drums has at least two control holes and each of said keys has at least two control projections engageable into two control holes of a respective one of said drums, the control holes of one drum and the control projections of one key having a location differing from that of the control holes of the other drum and the control projections of the other key, respectively.

* * * * *

UNITED STATES PATENT AND TRADEMARK OFFICE

CERTIFICATE OF CORRECTION

PATENT NO. : 4,216,664

DATED : August 12,1980

INVENTOR(S) : Roma Slavinsky

It is certified that error appears in the above—identified patent and that said Letters Patent is hereby corrected as shown below:

On the title page in item (76) "99-95" should read -- 99-05 --.

Signed and Sealed this

*Twenty-fifth* Day of *November 1980*

[SEAL]

*Attest:*

SIDNEY A. DIAMOND

*Attesting Officer*

*Commissioner of Patents and Trademarks*